US005919002A

United States Patent [19]

Ramp

[11] Patent Number: 5,919,002

[45] Date of Patent: Jul. 6, 1999

[54] METHOD OF REDUCING THE INCURSION OF STORM WATERS INTO SANITARY SEWER SYSTEMS

[76] Inventor: Floyd L. Ramp, 225 Hollywood St., Oberlin, Ohio 44074

[21] Appl. No.: 08/964,122

[22] Filed: Nov. 4, 1997

[51] Int. Cl.[6] ..... F16L 18/55

[52] U.S. Cl. ..... 405/154; 405/156

[58] Field of Search ..... 405/154, 156, 405/146, 150.1; 138/97; 156/287, 294; 264/516

[56] References Cited

U.S. PATENT DOCUMENTS

| | | | |
|---|---|---|---|
| 4,009,063 | 2/1977 | Wood | 156/71 |
| 4,135,958 | 1/1979 | Wood | 156/199 |
| 4,678,370 | 7/1987 | Allen | 405/154 |
| 4,770,562 | 9/1988 | Muller et al. | 405/154 |
| 4,986,951 | 1/1991 | Ledoux et al. | 264/516 |
| 5,368,809 | 11/1994 | Steketee, Jr. | 264/516 |
| 5,634,743 | 6/1997 | Chandler | 405/150.1 |

*Primary Examiner*—Dennis L. Taylor
*Attorney, Agent, or Firm*—Thompson Hine & Flory LLP

[57] ABSTRACT

A method for reducing leakage of effluent water from a storm sewer system, the method comprising securing a flexible, water-impermeable sleeve to the inlet end of a storm sewer line, extending the sleeve through the interior of storm sewer line, and severing the sleeve at the discharge end of the storm sewer line, wherein the sleeve forms a liner for the storm sewer line.

1 Claim, 1 Drawing Sheet

METHOD OF REDUCING THE INCURSION OF STORM WATERS INTO SANITARY SEWER SYSTEMS

BACKGROUND OF THE INVENTION

The present invention relates to a method of reducing the leakage of storm waters from a storm sewer system and, more particularly, it relates to the insertion of a flexible sleeve attached to the perimeter of the storm sewer line in the catch basin at the upstream end of a given segment of storm sewer to prevent or reduce effluent water from the storm sewer from entering into the sanitary sewer system.

Water control in municipal areas is normally divided into two components: sanitary and storm. The lines which collect sanitary waste lead to a facility with special apparatus and methods for removal of those materials which would degrade the quality of the stream accepting the discharge. Storm water, except in very unusual circumstances, may be discharged into adjacent streams without any treatment. The collection systems for these two streams are frequently inadequately isolated from one another. In fact early in the twentieth century they were some times deliberately combined so that storms would flush the sanitary system, resulting in the dumping of raw sewage into streams when the capacity of the treatment plant was exceeded. This became environmentally unacceptable, especially to those immediately downstream. Such systems have now been replaced.

In addition, the drains for storm waters from the downspouts and footers of homes are frequently tied into the sanitary sewer since the sanitary sewer is normally installed lower than the storm sewer. Water from this source contributes to the overload experienced at treatment plants during rainstorms. A concerted effort has been made in most communities to eliminate this source of storm waters entering the sanitary lines. In spite of these extensive and frequently expensive efforts, unacceptable flow increases in the sanitary lines during rain storms or winter runoff is still a common occurrence. This leads to the backup of raw sewage into basements as well as sewage facility overload. Holding ponds are commonly installed to prevent overflow into nearby streams, but this does not prevent raw sewage backup. In fact such backup may occur even in new homes that are connected to an existing system. This occurs because of the general nature of construction. Sanitary sewers have been intended to be hydrostatically sound for a number of years but older installations, constructed of vitreous tile joined with a mastic, commonly leak at these joints.

At the time of installation, the tile typically was laid level and covered with crushed rock. The rock was used to avoid the subsidence which would be encountered with soil fill. Furthermore the rock provided a firm base for the street, however, this structure allows for the rapid passage of water in and around the sanitary sewer line. When a break or any deterioration of the sanitary sewer line occurs, extraneous water outside the sanitary sewer line, such as storm water, finds its way into the sanitary sewer system. Streets are normally crowned to provide drainage. This requires cross street storm connections unless two parallel lines are provided for each street. Such parallel lines are seldom used because of the costs involved. It should further be noted that the object of storm drainage is to remove the water from the streets. Any water that can soak into the ground need not be provided for by larger lines downstream. Hence, no effort was made in older installations to insure the hydraulic integrity of storm lines. The result of this combination is that leaky storm lines frequently pass over crushed rock beds which cover leaky sanitary sewers. The net result is that very large quantities of storm waters are transferred from the storm sewers to the sanitary sewers with all the problems discussed above.

The situation can be corrected by replacement of one or both lines. This, however, is very labor intensive and, because of the great increase in underground utilities, represents an ever increasingly costly approach as well. Removal of any constrictions and construction of holding ponds have also been used. This, of course does not directly address the problem. In fact, new allotments have experienced raw sewage backup because of the inflow of storm water into the sanitary line even though the line immediately in front of the house is hydrostatically sound.

U.S. Pat. Nos. 4,009,063; 4,064,211; and 4,135,958 teach the use of a hollow plastic cylinder which is folded in such a manner that it can be inserted into the existing sanitary sewer. Pressure is applied to force this liner out against the walls. Heat is applied to cure this liner in the expanded shape. Extensive use of this method requires a method of reopening tap-in junctions which are closed off by the new liner. Special machines for this purpose are disclosed in U.S. Pat. Nos. 4,685,983; 4,819,721; and 5,368,423. In addition some digging is required with all the attendant dangers of damaging underground utilities whose positions may not be accurately known. This method had been found particularly cost effective only in instances where a large number of phone, electrical, and other utility lines are known to exist.

Accordingly, there is a need for a convenient and practical means for insuring that storm water is carried away by the storm sewer without leaking into the sanitary sewer system.

SUMMARY OF THE INVENTION

In accordance with the present invention, a flexible sleeve is attached at the perimeter of the upstream end of a storm sewer line an any catch basin. The attachment is made in such a manner as to require any water flowing out of the catch basin to flow through the sleeve. The sleeve bridges any leaks in the original storm line while still using the original line to determine the destination of the flow. The flexible sleeve size is chosen so that the annular surface of the sleeve rests against the original line at maximum flow. At lesser flows the flexible liner drops away permitting inflow from any connecting line. Thus at maximum flow the sleeve prevents backflow into lines (taps) connected to the storm line. At lesser flows only the bottom of the storm line will be covered so that any water from these taps, normally a house roof or sump drain, can flow in the normal manner. Containment of the bulk of the water within the sleeve prevents flow to the rock fill above the sanitary sewer. A particular advantage of the present invention is that it can be carried out without the need for excavation or digging.

DETAILED DESCRIPTION OF THE INVENTION

Figure 1:
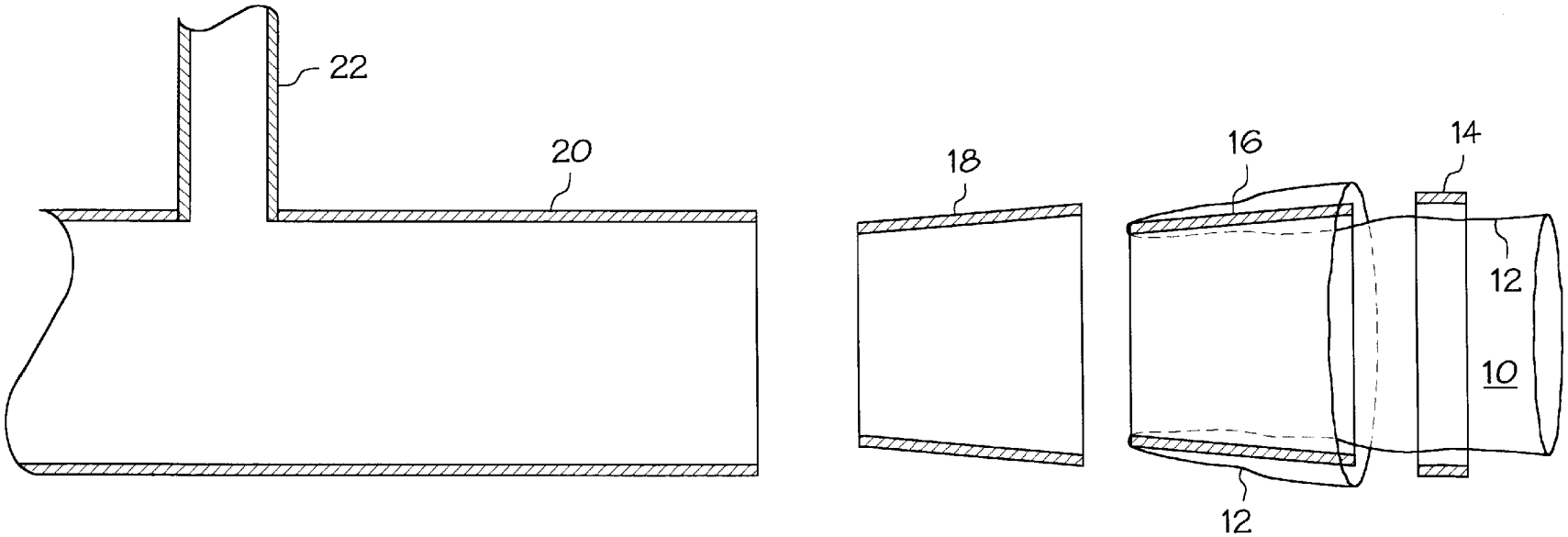
FIG. 1 is a cross-sectional side view of a storm sewer illustrating the present invention.

The invention is most conveniently carried out by use of blown film available in sleeve form, i.e., not slit, in very long lengths. Typically, the blown film is a polymeric material such as a polyolefin, e.g., polyethylene, particularly, linear low density polyethylene; plasticized polyvinylchloride; or urethane elastomer. The sleeve is turned up in such manner so that the inside 12 of the sleeve 10 will be placed against the sewer to be lined. The sleeve 10 is secured between the outer surface of a first hollow, tapered member 16 and the inner surface of a second hollow, tapered member 18. The second member 18 is wedged into the inlet end of a sewer in a manner which minimizes any tearing of the sleeve 10. The point of attachment to the sewer is normally in a catch basin. The film, so attached, inverts as water is added and the sleeve 10 is forced into the line by the water pressure. The uninverted sleeve 10 is, of course, still attached and is played out as required. Pulling on the sleeve 10 at the uninverted portion coming off the reel may serve to move past minor obstacles. When the inverting sleeve 10 emerges at the next catch basin it is held in that position to determine whether sharp glass or other objects in the sewer have damaged the liner. In the absence of such damage, the liner is cut in the downstream catch basin to complete the installation. The transfer of the water entering at the upstream catch basin to the one downstream with little or no leakage is thus assured.

The present invention does not require any particular method of installation. The only requirements are (1) that the sleeve 10 be sufficiently flexible so that it can be introduced, via a catch basin without enlargement, into the sewer 20, and (2) that the sleeve 10 be attached to the perimeter of the storm sewer 20 in such a manner that a substantial portion of the inflow on the upstream end must pass through the sleeve 10. The invention is particularly useful in sewer systems containing one or more tape lines 22.

EXAMPLE 1

Two tapered half gallon plastic containers 16 and 18, e.g. containers commonly used for sherbet, are modified as follows. The bottoms are cut out. The central portion of one of the lids is cut out leaving the outer ring 14 in tact. The end of blown polyethylene film with an expanded circumference of about six inches is inserted through the lid ring. The film is then inserted through one of the modified containers 16 from top to bottom. The film is folded back on the container 16 and held in place by snapping the lid ring 14 in place. The second modified container is placed over the first to wedge the film between the two containers 16 and 18. The latter container 18 prevents roughness of the existing sewer line from damaging the film at the point of attachment. The small end of these modified containers with the film secured between is inserted into the existing storm sewer 20 at the upstream end in a catch basin. Water is added to the catch basin. The water presses the film into the existing sewer 20. The sleeve 10 is then played out slowly as the water forces the sleeve 10 further into the sewer line. When the film appears at the downstream catch basin, the addition of water is stopped and the film is held in place at the upstream end. This situation is retained for a few minutes to determine whether the film has been torn by glass fragments in the sewer. If there is leakage the film is removed and the sewer cleaned in the normal manner and the process repeated. When the film shows no sign of installation damage, it is cut off at the downstream end and the unexpanded portion pulled out at the upstream end. The installation is now complete.

EXAMPLE 2

A tether ball is attached to a light rope long enough to extend through the sewer to be lined. The ball is forced through the sewer by a stream of water. The liner film is attached to the line and pulled through the length of the sewer to be lined. The upstream end of the film is folded over the protruding end of the existing sewer and clamped in place with a large hose clamp. The integrity of the system may be tested by adding water at the upstream catch basin and determining whether any escapes downstream. When it has been determined that the film was not torn during installation, the line is removed from the downstream end and the installation is complete.

What is claimed is:

1. A method for reducing leakage of effluent water from a storm sewer system having one or more tap lines, said method comprising:

a) providing:

i) tapered, interlocking first and second cooperating members, each of said members having an interior surface and an exterior surface, the exterior surface of said first member being of a size and shape to cooperate with the interior surface of said storm sewer line, and the exterior surface of said second member being of a size and shape to cooperate with the interior surface of said first member, ii) a ring member shaped to annularly cooperate with a perimeter defining the inlet end of said second tapered coupling member, and iii) a flexible linear, low density polyethylene sleeve of a size such that the annular surface of the sleeve rests against the interior annular surface of the storm sewer system, b) inserting one end of said sleeve through said ring member and into the inlet opening of said second member;

c) extending said one end of said sleeve through said second member to a predetermined point past the discharge opening of said second member;

d) folding said one end of said sleeve back over the exterior surface of said second member;

e) locking said ring member around the perimeter of said inlet end of said second tapered coupling member to secure said sleeve thereto;

f) inserting said second member into said first member wherein said sleeve resides between the exterior surface of said second member and the interior surface of said first member, said sleeve being secured there between;

g) inserting said first and said second cooperating members into the inlet opening of said storm sewer system such that the exterior surface of said first member mates with the interior surface of said storm sewer;

h) extending said sleeve through the interior length of said storm sewer system wherein the interior and exterior surfaces of said sleeve are inverted, said inverted sleeve forming a liner therein such that, when said effluent water is at maximum flow, the exterior annular surface of said liner resides along the interior annular surface of said storm sewer system wherein backflow of storm water into said one or more tap lines is prevented, and, when said effluent water is at less than maximum flow, said liner relaxes such that only a portion of the exterior annular surface of said liner resides along the interior annular surface of said storm sewer system at its lowest point of gravity permitting extraneous effluent water from said one or more tap lines to flow into said storm sewer, wherein said extraneous effluent water from said one or more tap lines flows into said storm sewer system between the exterior surface of said liner and the interior surface of said storm sewer line; and i) severing said sleeve at the discharge end of said storm sewer system.

* * * * *